US006047855A

United States Patent [19]

Lin

[11] Patent Number: 6,047,855

[45] Date of Patent: Apr. 11, 2000

[54] AUTOMATIC VENDING MACHINE

[75] Inventor: Wen-Hsiang Lin, Isesaki, Japan

[73] Assignee: Sanden Corp., Isesaki, Japan

[21] Appl. No.: 09/020,554

[22] Filed: Feb. 9, 1998

[30] Foreign Application Priority Data

Feb. 25, 1997 [JP] Japan ..... 9-040681

[51] Int. Cl.[7] ..... A24F 27/14

[52] U.S. Cl. ..... 221/150 HR; 221/150 R; 221/131

[58] Field of Search ..... 221/150 HR, 150 R, 221/131, 192, 253

[56] References Cited

U.S. PATENT DOCUMENTS

| | | | |
|---|---|---|---|
| 4,483,459 | 11/1984 | Taylor et al. | 221/14 |
| 4,986,441 | 1/1991 | Kambe et al. | 221/131 |
| 5,516,003 | 5/1996 | Herbert | 221/131 |
| 5,848,726 | 12/1998 | Yajima et al. | 221/150 HR |

FOREIGN PATENT DOCUMENTS

| | | | |
|---|---|---|---|
| 73494 | 3/1990 | Japan | 221/192 |
| 404018694 | 1/1992 | Japan | 221/150 HC |
| 405242352 | 9/1993 | Japan | 221/192 |
| 5-334542 | 12/1993 | Japan . | |

*Primary Examiner*—William E. Terrell
*Assistant Examiner*—Khoi H. Tran
*Attorney, Agent, or Firm*—Kenjiro Hidaka

[57] ABSTRACT

An automatic vending machine has a plurality of commodity storage chambers in a side-by-side arrangement that are divided from one another by thermally-insulating vertical dividers so that each chamber can be heated or refrigerated individually. Each chamber has a plurality of vertically spaced commodity shelves and an elevator bucket that is adapted to receive a commodity from a selected shelf. All of the elevator buckets are rigidly connected by laterally extending connecting members that are disposed through respective vertically extending slots in the dividers, so that a single unit of plural elevator buckets acts to fetch a selected commodity, heated or cooled. A pair of flexible heat-shielding sealing strips are securely fitted in each of the slots in a manner that each of the connecting members slides on and between the corresponding pair of the sealing strips to prevent communication between the adjacent chambers as the connecting member moves vertically.

6 Claims, 7 Drawing Sheets

AUTOMATIC VENDING MACHINE

BACKGROUND OF THE INVENTION

1. Field of the Invention

The present invention relates to an automatic vending machine having a plurality of commodity storage chambers arranged side by side for dispensing beverages or foods. The vending machine employs a heating system and a refrigerating system so that the commodity storage chambers can be either heated or cooled individually.

2. Description of the Prior Art

In known automatic vending machines there are provided a plurality of vertical commodity storage chamber sections arranged in a side by side fashion as disclosed in Japanese patent publication, laid-open no. 5-334542 dated Dec. 17, 1993. In this vending machine, adjacent chamber sections can be partitioned off from each other by a removable one-piece thermally-insulating divider panel. By placing the divider panel at a location between selected adjacent chamber sections, two storage chambers, each consisting of one or more chamber sections, and thermally shielded from each other, can be formed side by side.

The same vending machine is equipped with a heating system and a refrigerating system so that the divided two storage chambers can be either heated or cooled individually, whereby the single vending machine can store and dispense both cold beverages and warm foods, for example.

It is further disclosed in the Japanese patent publication that a plurality of serpentine-type commodity storage racks are provided in each of the commodity storage chamber sections and a commodity take-out port is provided for each of the chamber sections.

Serpentine-type racks are widely used in prior known automatic vending machines. Each unit of the serpentine-type commodity racks, however, can carry only a single kind of commodity because all pieces of the commodity loaded on the same rack drop by own gravity through a zigzag path as the lowest piece of the commodity on the same rack is dispensed, one piece at a time.

Also known is an automatic vending machine having a plurality of vertically spaced commodity shelves. U.S. Pat. No. 4,483,459 discloses a vending machine for dispensing particularly bottles and cans. This vending machine has a plurality of vertically spaced inclined shelves and an elevator commodity carrier that can pick up a commodity from a selected shelf and transport the commodity to a dispensing station at the top of the machine. This kind of automatic vending machine can store comparatively greater number of kinds of commodity per unit storage space as compared with a vending machine having serpentine-type commodity racks because each of the vertically spaced shelves can carry a different kind of commodity.

But this kind of vending machine must employ a complex commodity pick-up and transport mechanism, and a controller therefore, that is capable of receiving a commodity from any selected shelf and transporting it to the dispensing port of the vending machine.

If an automatic vending machine has a plurality of commodity storage chambers, which can be either heated or refrigerated individually, and vertically spaced commodity shelves in each of the commodity storage chambers, the vending machine would require a separate commodity pick-up and transport mechanism, such as a separate elevator commodity carrier for each of the commodity storage chambers, and a controller for operating the separate mechanisms.

A vending machine having separate commodity storage chambers that can be either heated or refrigerated, therefore, would need either serpentine-type commodity racks that can carry comparatively small number of kinds of commodity or units of vertically spaced commodity shelves that can carry greater number of kinds of commodity but requiring complicated commodity pick-up and transport mechanisms.

SUMMARY OF THE INVENTION

In view of the above situation, it is an object of the present invention to provide an automatic vending machine having a plurality of commodity storage chambers that can be either heated or refrigerated individually, each chamber containing one or more units of vertically spaced commodity shelves, and yet, the vending machine has a single commodity dispensing port and a simple commodity receiving and transport mechanism that acts to transport a commodity from any selected shelf in any of the chambers to the commodity dispensing port.

In order to achieve the above object, an automatic vending machine according to the present invention has the features as described below.

The vending machine has a thermally-insulating housing, a plurality of commodity storage chambers arranged side by side and divided from each other by thermally-insulating vertical chamber dividers fixedly installed in the housing. Each of the commodity storage chambers contains one or more units of horizontal commodity shelves vertically spaced and each shelf is equipped with an endless conveyor belt for moving the commodity thereon frontwardly. An elevator bucket is installed in front of the shelves in each of the commodity storage chambers that is adapted to receive a commodity from the front end of any selected shelf when the conveyor belt of the selected shelf moves the commodity frontwardly.

Each of the commodity storage chambers also contains a heating unit and a cooling unit so that each of the chambers can individually be heated, cooled, or, if so desired, left at the ambient temperature.

Each of the vertical chamber dividers has a vertically extending slot in a front section thereof and each slot has a pair of flexible sealing strips securely fitted therein. The elevator buckets in the respective commodity storage chambers that are adjacent to each other are fixedly connected with each other by a connecting member in a manner that the connecting member is disposed through the vertical slot of the divider that separates the adjacent chambers between the pair of the sealing strips fitted in the slot, whereby all of the elevator buckets are fixedly connected with one another and always jointly moved vertically by a single unit of drive mechanism.

Since each of the connecting members keeps close sliding contacts with the corresponding pair of sealing strips when all of the buckets and the connecting members make vertical movements, any undesirable airflow between adjacent commodity chambers through the vertical slot can be prevented.

Each of the flexible strips has an elongated main strip and a pair of elongated sealing tongues attached to lateral sides of the main strip. Each of the main strips has either a plurality of concavities or dense bristles on the side where the corresponding connecting member makes contact in order to facilitate smooth and close sliding contacts with the connecting member and effectively block airflow between the sealing strips as the connecting member vertically moves therebetween.

DETAILED DESCRIPTION OF THE PREFERRED EMBODIMENTS

The present invention will now be described in detail with reference to FIGS. 1–7.

In FIGS. 1–7, arrows I, II, III, IV, V and VI signify front, rear, left, right, up and down positional directions, respectively, which should be interpreted as defined in the present specification.

Figure 1:
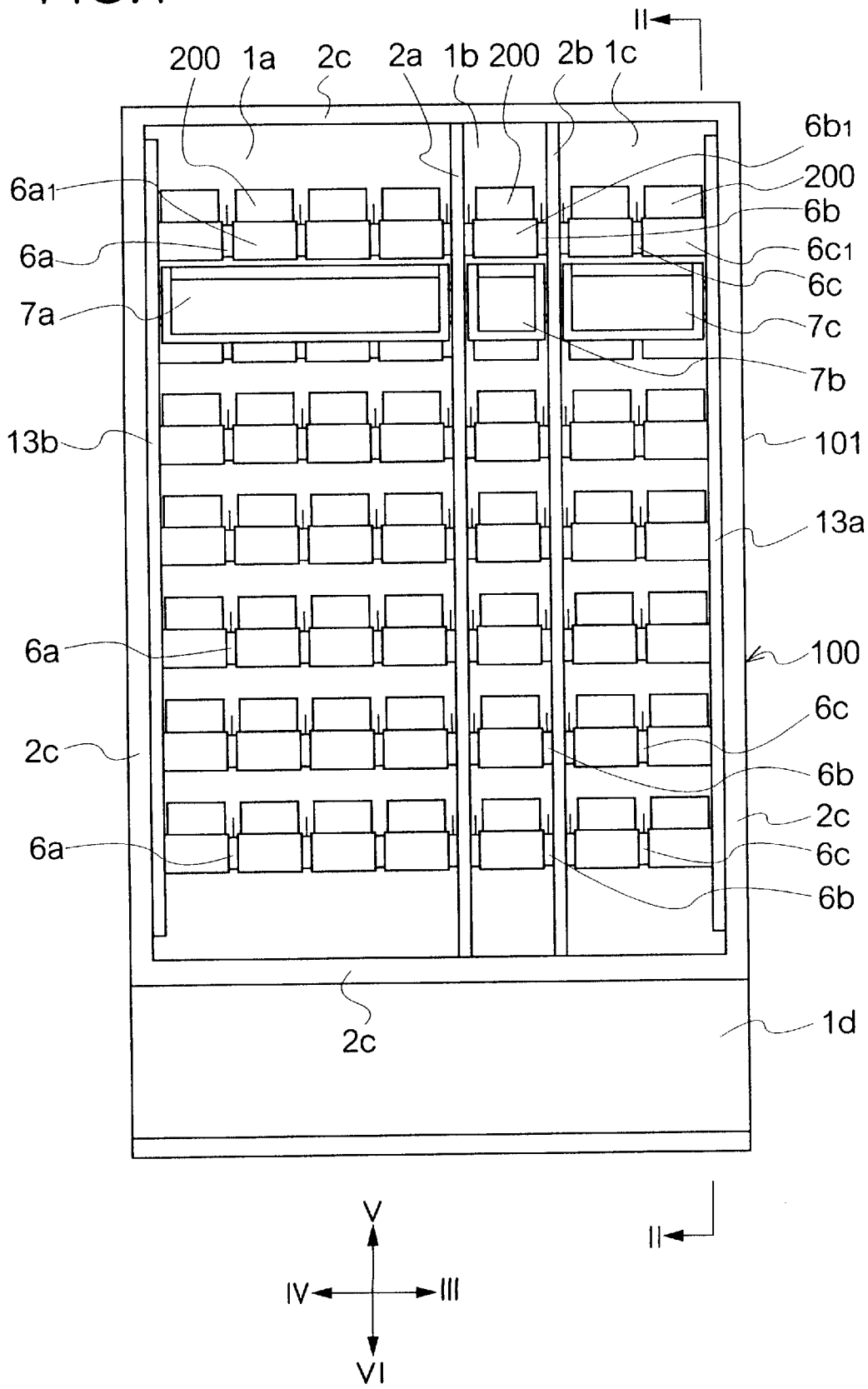
FIG. 1 is a front elevational view of an automatic vending machine, whose internal and external doors are removed, according to the present invention.
Figure 2:
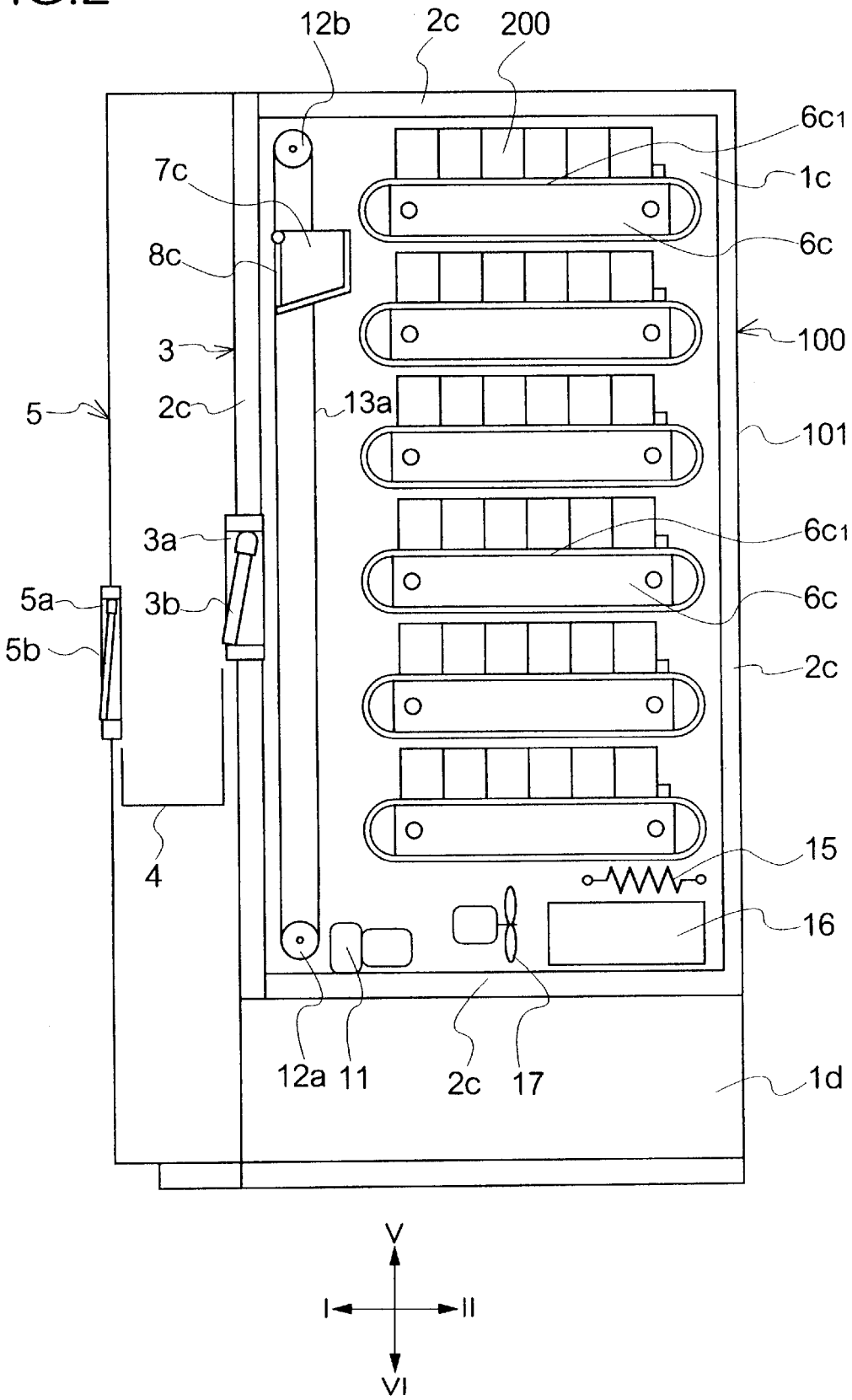
FIG. 2 is a side elevational sectional view of the vending machine taken along the line II—II in FIG. 1.

As shown in FIGS. 1 and 2, an automatic vending machine 100 has a housing 101 that has therein commodity storage chambers 1*a,* 1*b* and 1*c,* arranged side by side, and a machinery compartment 1*d* under the chambers 1*a,* 1*b* and 1*c.* The chambers 1*a,* 1*b* and 1*c* are enclosed by thermally-insulating walls 2*c.* The chambers 1*a* and 1*b* are separated from each other by a vertical thermally-insulating chamber divider 2*a* and the chambers 1*b* and 1*c* are separated from each other by a vertical thermally-insulating chamber divider 2*b,* both of which are fixed to the hosing 101.

In reference to FIG. 2, the vending machine 100 further has, on the front side thereof, a thermally-insulating internal door 3 and an external door 5, both of which are hinged to the housing 101, and a commodity receiving tray 4. The internal door 3, when closed, also serves as the front-side wall of the thermally-insulating walls 2*c.* The internal door 3 has, at its approximately a middle level, a laterally extending commodity outlet 3*a* that has a flipping shutter 3*b.* The commodity receiving tray 4 is also laterally extending and is securely fixed to the housing 101. The tray 4 is disposed between the internal door 3 and the external door 5 at a level a little below the commodity outlet 3*a,* so that all of the commodities exiting through the commodity outlet 3*a* are received by the tray 4. The external door 5 has, at a level a little higher than the receiving tray 4, a laterally extending commodity take-out port 5*a* that has a flipping shutter 5*b.*

Referring to FIGS. 1 and 2, groups of horizontal commodity shelves 6*a,* 6*b,* and 6*c* are disposed in a manner that each group of the shelves 6*a,* 6*b,* and 6*c* are vertically evenly spaced in the chambers 1*a,* 1*b* and 1*c,* respectively. Each of the shelves 6*a* at an even level has four conveyer belts 6*a*1 arranged side by side in parallel with each other. Likewise, each of the shelves 6*b* at an even level has one conveyer belt 6*b*1 and each of the shelves 6*c* at an even level has two conveyer belts 6*c*1 arranged side by side in parallel with each other. Each of the conveyer belts 6*a*1, 6*b*1 and 6*c*1 can be operated individually so that commodities 200 on any of the conveyer belts is moved frontwardly when the conveyer belt is selectively actuated.

Figure 3:
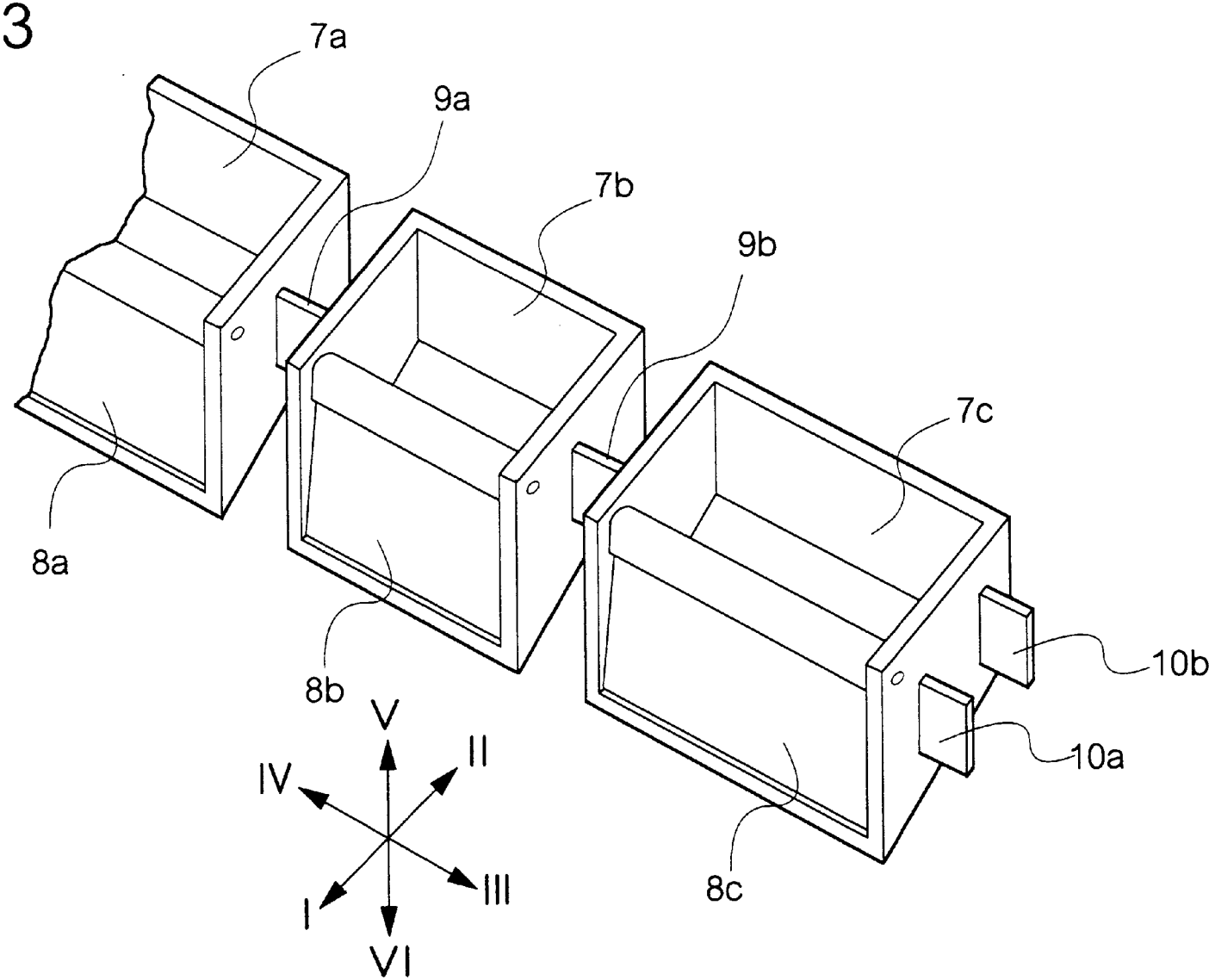
FIG. 3 is a perspective partial view of elevator buckets and bucket connecting members employed in the vending machine shown in FIG. 1.

Referring to FIGS. 2 and 3, vertically movable commodity receiving elevator buckets 7*a,* 7*b* and 7*c* are disposed in the chambers 1*a,* 1*b* and 1*c,* respectively. The buckets 1*a,* 1*b* and 1*c* have flipping front gates 8*a,* 8*b* and 8*c,* respectively, and each of the buckets 7*a,* 7*b* and 7*c,* has a frontwardly descending bottom. As shown in FIG. 3, the buckets 7*a* and 7*b* are fixedly connected with each other by a connecting member 9*a* and the buckets 7*b* and 7*c* are fixedly connected with each other by a connecting member 9*b* in a manner that all of the buckets 1*a,* 1*b* and 1*c* are horizontally aligned, so that all of the buckets 1*a,* 1*b* and 1*c* are vertically moved always together in the chambers 1*a,* 1*b* and 1*c,* respectively. A pair of supporting plates 10*a,* 10*b* are fixedly attached to the left side wall of the bucket 7*c* and, though not shown, a pair of supporting plates are likewise fixedly attached to the right side wall of the bucket 7*a.* Each pair of the supporting plates are slidably fitted to a corresponding pair of vertical guide grooves (not shown) that are formed in each of the right and left heat shielding walls 2*c* of the chambers 1*a* and 1*c,* respectively.

Referring to FIG. 2, in a bottom front part of the chamber 1*c* are installed a bi-directional motor 11 and a driving pulley 12*a* that is driven by the motor 11. In a top front part of the chamber c and directly above the driving pulley 12*a* is disposed a driven pulley 12*b.* An endless drive belt 13*a* vertically runs over the driving and driven pulleys 12*a* and 12*b.* Likewise, though not shown, a second driving pulley and a second driven pulley are disposed in front parts of the chamber 1*a* at the same levels as of the driving pulley 12*a* and the driven pulley 12*b,* respectively, and a second drive belt 13*b* (FIG. 1) vertically runs over the second driving pulley and the second driven pulley. The driving pulley 12*a* and the second driving pulley are drivably connected with each other by a first horizontal drive shaft (not shown) through small sealed holes (not shown) of the dividers 2*a* and 2*b.* Likewise, the driven pulley 12*b* and the second driven pulley are drivably connected with each other by a second horizontal drive shaft (not shown) through small sealed holes (not shown) of the dividers 2*a* and 2*b.*

The supporting plates 10*a,* 10*b* attached to the left-side wall of the bucket 7*c* are secured to the endless belt 13*a,* and the supporting plates (not shown) attached to the right-side wall of the bucket 7*a* are secured to the endless belt 13*b,* so that all of the buckets 7*a,* 7*b* and 7*a* are vertically moved up or down as the endless belts are driven by the bi-directional motor 11.

Figure 4:
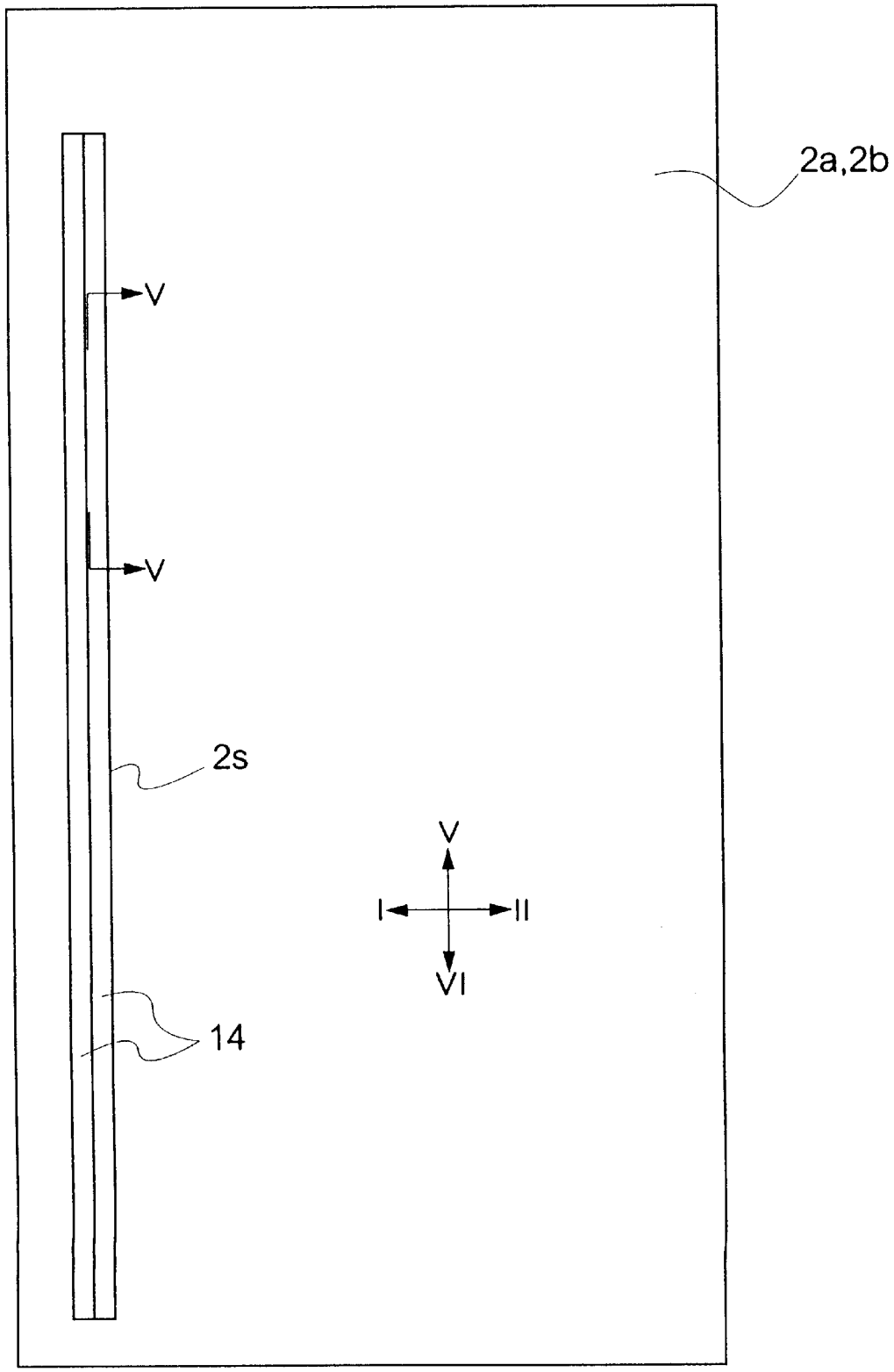
FIG. 4 is a side elevational view of a thermally-insulating chamber divider employed in the vending machine shown in FIG. 1 that has a vertically extending slot and a pair of flexible sealing strips securely attached thereto.

Referring to FIG. 4, each of the thermally-insulating dividers 2*a* and 2*b* has a vertically extending slot 2*s* in a proximity of the front end thereof. A pair of elongated sealing strips 14 are securely fitted to the vertical slot 2*s* of each of the dividers 2*a,* 2*b* and bonded to the respective dividers with an acrylic bonding agent. Each pair of the sealing strips 14 are made of a flexible and heat-shielding material, such as ester polyurethane foam, and are positioned opposing to, and in close contact with, each other in the corresponding slot 2*s.*

Figure 5:
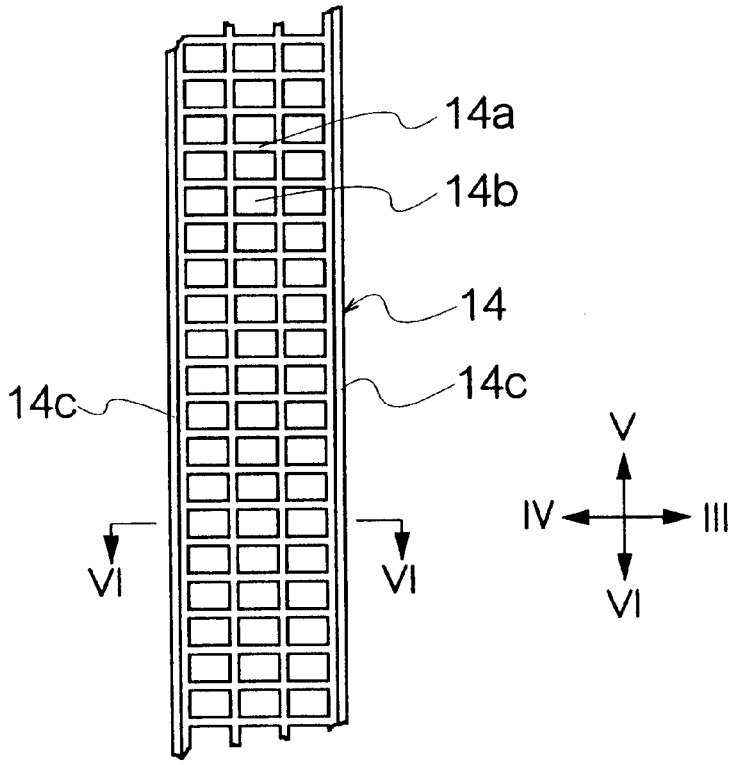
FIG. 5 is an enlarged elevational partial front view of one of the pair of the sealing strips taken along the line V—V in FIG. 4.
Figure 6:
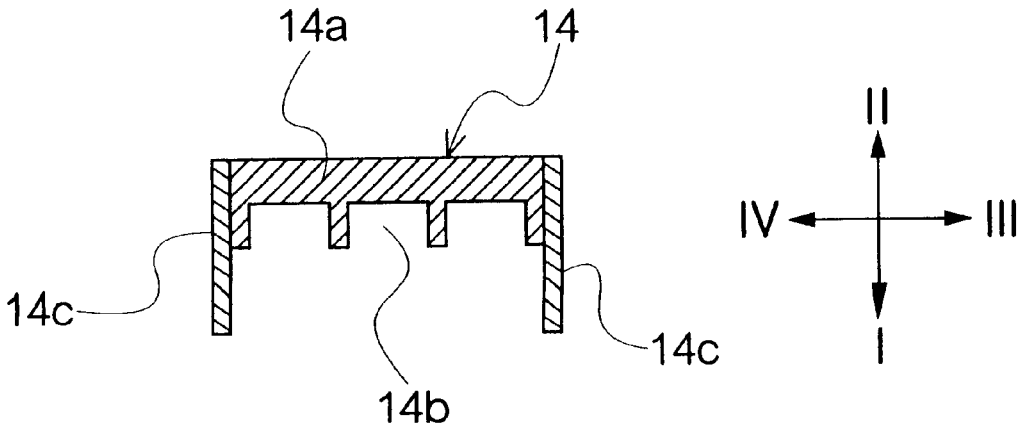
FIG. 6 is an enlarged top sectional view of the sealing strip taken along the line VI—VI in FIG. 5.

Referring to FIGS. 5 and 6, each of the sealing strips 14 consists of a main strip 14*a* and a pair of tongues 14*c* attached to the lateral sides of the main strip 14*a.* Each of the main strip 14*a* has a plurality of concavities 14*b* of a uniform form on the side opposing to the other strip of the pair.

Figure 7:
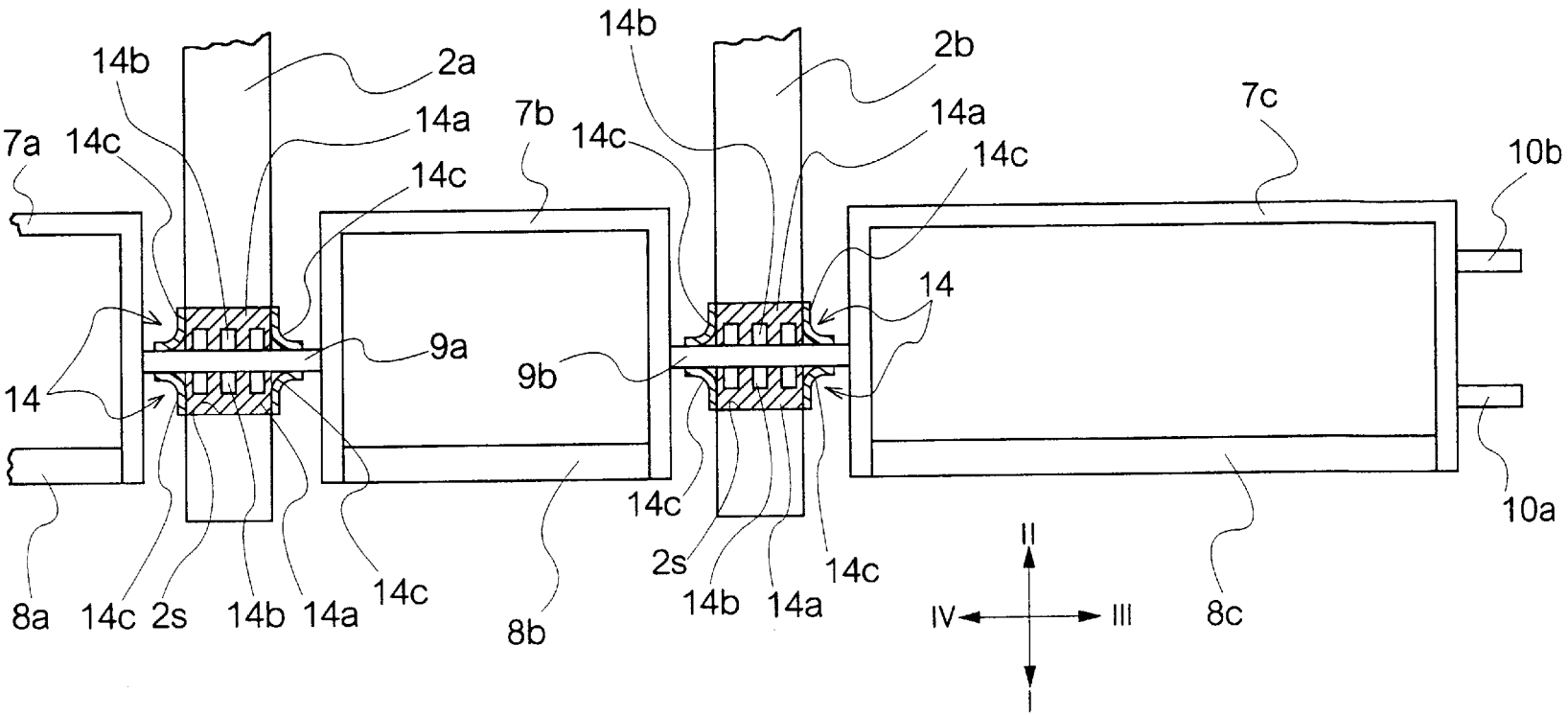
FIG. 7 is a partial top sectional view particularly showing positional relations among the elevator buckets and the bucket connecting members, shown in FIG. 3, the thermally-insulating dividers and the flexible sealing strips, shown in FIG. 4.

Referring to FIG. 7, the connecting member 9*a,* which connects the bucket 7*a* with the bucket 7*b,* is disposed between the pair of opposed sealing strips 14 fitted in the slot 2*s* of the divider 2*a* in a manner that the connecting member 9*a* can vertically move, sliding on and between the opposed sealing strips 14. The opposing surfaces having the concavities 14*b* of the main strips 14*a* and the flexed tips of the tongues 14*c* of the sealing strips 14 maintain close contacts with the connecting member 8*a* so that the sealing strips 14 effectively block airflow between the chambers 1*a* and 1*b* when the connecting member 9*a* moves vertically through the slot 2*s* of the divider 2*a* between the opposed sealing strips 14. Likewise, the connecting member 9*b,* which connects the bucket 7*b* with the bucket 7*c,* is disposed between the pair of opposed sealing strips 14 fitted in the slot 2*s* of the divider 2*b* in a manner that the connecting member 8*a* can vertically move, sliding on and between the opposed sealing strips 14, so that airflow between the chambers 1*b* and 1*c* can be prevented when the connecting member 9*b* moves vertically through the slot 2*s* of the divider 2*b* between the opposed sealing strips 14, as in the case of the connecting member 9*a.*

Referring to FIG. 2, an electric heater 15, a cooler 16, which is a heat exchanger (i.e. evaporator) of a refrigeration system, and an air blower 17 are installed in bottom parts of each of the chambers 1*a,* 1*b* and 1*c*. Although not shown, other equipment of the refrigeration system, such as a refrigerant compressor, is installed in the machinery compartment 1*d.*

Now, the operation of the automatic vending machine 100 will be explained.

As an exemplified case, it is assumed that the chamber 1*a* is heated by the heater 15 and the chambers 1*b* and 1*c* are refrigerated by the respective coolers 16. Each of the blowers 17 enables efficient circulation of cooled or heated air in the corresponding chamber.

When a customer selectively pushes one of the commodity selection buttons (not shown) installed in the external door 5, a controller (not shown) causes the motor 11 to be driven in a proper direction as directed by the controller. Then, the pulleys 12*a,* 12*b* are rotated, the endless belts 13*a,* 13*b* are driven, and the elevator buckets 7*a,* 7*b* and 7*c* are vertically moved to the level of the commodity shelf that is designated by the controller according to the commodity selection made by the customer. As the buckets 7*a,* 7*b* and 7*c* move vertically, the connecting members 9*a,* 9*b* move between the respective pairs of the sealing strips 14 maintaining close sliding contacts with the respective main strips 14*a* and the tongues 14*c.*

If, for example, the commodity 200 selected by the customer to be dispensed is on one of the four conveyor belts 6*a*1 of the third shelf 6*a* from the top in the chamber 1*a,* the corresponding conveyor belt 6*a*1 is driven according to the instructions by the controller, the commodity, which is heated, is moved frontwardly by the conveyor belt 6*a*1 and dropped into the elevator bucket 7*a*. Since the bucket shutter 8*a* is normally latched, the commodity is held in the bucket 7*a* for the time being. Then, the bucket 7*a,* together with the buckets 7*b,* 7*c,* is moved down to the level of the commodity outlet 3*a*. Next, the controller causes the bucket shutter 8*a* (FIG. 7) to be unlatched by a triggering solenoid (not shown), thereby causing the commodity in the bucket 7*a* to slide down frontwardly on the sloped bottom of the bucket 7*a*. The weight of the commodity forces the shutter 8*a* to open, and the commodity drops into the commodity receiving tray 4. The customer manually opens the flipping shutter 5*b* and takes out the heated commodity through the commodity take-out port 5*a*.

If, for example, the commodity 200 selected by the customer to be dispensed is on the belt 6*b*1 of the third shelf 6*b* from the top in the chamber 1*b,* the corresponding belt 6*b*1 is driven according to the instructions by the controller, the commodity, which is cooled, is moved frontwardly by the conveyor belt 6*b*1 and dropped into the elevator bucket 7*b*. Then, the commodity is vertically moved by the bucket 7*b* to the level of the commodity outlet 3*a,* and dropped into the commodity receiving tray 4 through the commodity outlet 3*a* as the bucket shutter 8*b* is unlatched. The customer takes out the cooled commodity through the commodity take-out port 5*a,* as in the case of the above example.

If, for example, the commodity 200 selected by the customer to be dispensed is on one of the two belts 6*c*1 of the third shelf 6*c* from the top in the chamber 1*c,* the corresponding belt 6*c*1 is driven according to the instructions by the controller, the commodity, which is also cooled, is moved frontwardly by the conveyor belt 6*c*1 and dropped into the elevator bucket 7*c*. Then, the commodity is vertically moved by the bucket 7*c* to the level of the commodity outlet 3*a,* and dropped into the commodity receiving tray 4 through the commodity outlet 3*a* as the bucket shutter 8*c* is unlatched. The customer takes out the cooled commodity through the commodity take-out port 5*a,* as in the case of the above examples.

In the automatic vending machine 100 according to the present invention, the three commodity chambers 1*a,* 1*b* and 1*c* are physically separated and thermally insulated from one another by the thermally-insulating dividers 2*a* and 2*b,* and each of the three chambers 1*a,* 1*b* and 1*c* is equipped with the heater 15, the cooler 16 and the air blower 17. Since the vertically movable elevator buckets 7*a,* 7*b* and 7*c* are disposed in the chambers 1*a,* 1*b* and 1*c,* respectively, the vending machine 100 can dispense either heated commodity or cooled commodity at customer's choice. It goes without saying that any of the commodity chambers 1*a,* 1*b* and 1*c* may be kept at the ambient temperature without being heated or cooled, if so desired by the user.

Furthermore, in the automatic vending machine 100 according to the present invention, the elevator buckets 7*a,* 7*b* and 7*c* are connected with one another and all of the connected buckets 7*a,* 7*b* and 7*c* are vertically moved by a single unit of drive mechanism including the motor 11 and the endless belts 13*a,* 13*b,* the drive mechanism is simple in construction and the cost economy of the vending machine 100 is, therefore, enhanced. Since each of the thermally-insulating dividers 2*a* and 2*b* has the vertically extending flexible sealing strips 14, securely fitted in the corresponding slot 2*s,* and the elevator buckets 7*a,* 7*b* and 7*c* are connected with one another by the connecting members 9*a* and 9*b* that are disposed between the respective pairs of the sealing strips 14, and the sealing strips 14 always maintain close contacts with the respective connecting members 9*a* and 9*b,* the vertical movements of the connecting members 9*a* and 9*b* do not cause any communication between adjacent chambers, thereby preventing thermal loss when there is a temperature difference between the adjacent chambers.

Even still, the flexible tongues 14*c* are attached to the lateral sides of each of the main strips 14*a,* and the tongues 14*c* maintain close contacts with the respective connecting members 9*a* and 9*b*. The tongues 14*c,* therefore, additionally ensure the sealing effect of the sealing strips 14.

Additionally, the concavities 14*b* formed on the opposed sides of the main strips 14*a* of each pair of the sealing strips

14 serve as air pockets that cause to minimize heat conduction through the sealing strips 14, thereby also preventing thermal loss between the adjacent chambers.

Figure 8:
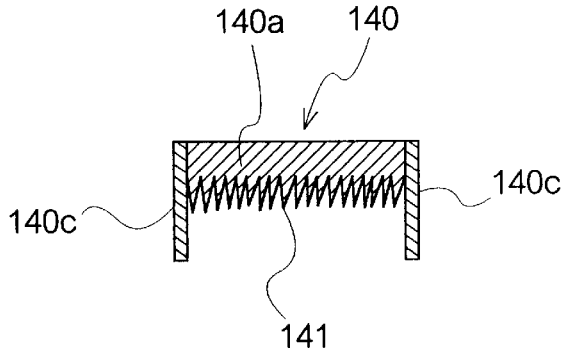
FIG. 8 is an enlarged top sectional view of one of flexible sealing strips of an alternative type that can be substituted for the flexible sealing strips shown in FIGS. 5, 6 and 7.

FIG. 8 is an enlarged top sectional view of one of flexible sealing strips 140 of an alternative type, made of polypropylene, that can be substituted for the flexible sealing strips 14 shown in FIGS. 5, 6 and 7. Each of the substitute flexible sealing strips 140 has a main strip 140*a* that has dense bristles 141 on the side opposing to the other strip of the pair and a pair of tongues 140*c* attached to the lateral sides of the main strip 140*a*. The forms of the tongue 140*c* are identical to those of the tongues 14*c* of the sealing strips 14 described above.

The bristles 141 and the tongues 140*c* maintain close contacts with the respective connecting members 9*a* and 9*b*, when the connecting members 9*a* and 9*b* vertically move between respective pairs of the sealing strips 140, thereby blocking airflow between adjacent commodity chambers 1*a* and 1*b* or 1*b* and 1*c*, as in the case of the sealing strips 14.

In alternative embodiments, the tongues 14*c* and 140*c* may be attached to only one lateral side of each of the main strips 14*a* and 140*a*, respectively.

Although three commodity chambers 1*a*, 1*b*, 1*c* are provided in the above described embodiment, the number of the commodity chambers may be properly changed in alternative embodiments.

It should also be understood that various changes and modifications may be made in the above described embodiments which provide the characteristics of the present invention without departing from the spirit and principle thereof particularly as defined in the following claims.

What is claimed is:

1. An automatic vending machine, comprising:

(a) a thermally-insulating housing;

(b) a thermally-insulating vertical chamber divider fixedly installed in said housing in a manner that a first commodity storage chamber and a second commodity storage chamber are formed in said housing in a side-by-side arrangement that are divided from each other by said divider, said divider having a vertically extending slot and a means for blocking airflow between said first and second commodity storage chambers that is securely fitted in said vertical slot;

(c) a plurality of first commodity shelves vertically spaced and a plurality of second commodity shelves vertically spaced that are fixedly installed in said first chamber and said second chamber, respectively;

(d) a first commodity elevator carrier and a second commodity elevator carrier disposed in said first chamber and said second chamber, respectively, each of said first elevator carrier and said second elevator carrier being adapted to receive a commodity from a selected one of said first shelves and said second shelves, respectively, said first commodity elevator carrier and said second commodity elevator carrier being connected with each other by a connecting member in a manner that said connecting member is disposed through said vertical slot of said divider so that said first and second commodity elevator carriers move vertically and always jointly; and (e) means for heating said first chamber and means for refrigerating said second chamber.

2. An automatic vending machine according to claim 1, wherein said means for blocking airflow between said first and second commodity storage chambers is a pair of heat-shielding flexible sealing strips that are adapted to accept said connecting member therebetween.

3. An automatic vending machine according to claim 2, wherein each of said pair of sealing strips has an elongated main body and at least one elongated sealing tongue attached to a side of said main body.

4. An automatic vending machine according to claim 3, wherein said main body has a plurality of concavities on one side thereof.

5. An automatic vending machine according to claim 3, wherein said main body has dense bristles on one side thereof.

6. An automatic vending machine, comprising:

(a) a thermally-insulating housing;

(b) at least one thermally-insulating vertical chamber divider fixedly installed in said housing in a manner that a plurality of commodity storage chambers, which are separated from each other by said chamber divider, are formed in a side-by-side arrangement in said housing, said chamber divider having a vertically extending slot and a means for blocking airflow between said chambers through said slot;

(c) a plurality of vertically spaced commodity shelves fixedly disposed in each of said chambers;

(d) a vertically movable commodity elevator carrier disposed in each of said chambers, each of said elevator carriers being adapted to receive a commodity from a selected one of said shelves in one of said chambers, any pair of said commodity elevator carriers that are disposed in a pair of said chambers adjacent to each other being securely connected with each other by a connecting member in a manner that said connecting member is disposed through the vertical slot of the chamber divider that is interposed between said pair of adjacent chambers from each other so that all of said commodity elevator carriers vertically move always jointly; and (e) means for heating each of said chambers and means for refrigerating each of said chambers.

* * * * *